US011807960B2

(12) United States Patent
Siniscalchi et al.

(10) Patent No.: US 11,807,960 B2
(45) Date of Patent: Nov. 7, 2023

(54) FREE FIBRE PADDING STRUCTURE AND METHOD FOR THE PRODUCTION THEREOF

(71) Applicant: Fisi Fibre Sintetiche S.P.A., Oggiono (IT)

(72) Inventors: Lucio Siniscalchi, Milan (IT); Patrizio Siniscalchi, Milan (IT)

(73) Assignee: FISI FIBRE SINTETICHE S.P.A., Oggiono (IT)

( * ) Notice: Subject to any disclaimer, the term of this patent is extended or adjusted under 35 U.S.C. 154(b) by 741 days.

(21) Appl. No.: 16/637,694

(22) PCT Filed: Sep. 3, 2018

(86) PCT No.: PCT/IB2018/056703
§ 371 (c)(1),
(2) Date: Feb. 7, 2020

(87) PCT Pub. No.: WO2019/049015
PCT Pub. Date: Mar. 14, 2019

(65) Prior Publication Data

US 2021/0148021 A1 May 20, 2021

(30) Foreign Application Priority Data

Sep. 6, 2017 (IT) ..... 102017000099945

(51) Int. Cl.

| | |
|---|---|
| ***D01G 7/00*** | (2006.01) |
| ***D04H 1/4391*** | (2012.01) |
| ***D04H 1/50*** | (2012.01) |
| ***D01G 13/00*** | (2006.01) |
| ***D01G 15/02*** | (2006.01) |
| *D04H 1/4382* | (2012.01) |
| *D04H 1/02* | (2006.01) |

(52) U.S. Cl.
CPC ..... *D01G 7/00* (2013.01); *D01G 13/00* (2013.01); *D01G 15/02* (2013.01); *D04H 1/43918* (2020.05); *D04H 1/50* (2013.01); *D04H 1/02* (2013.01); *D04H 1/43825* (2020.05); *D04H 1/43835* (2020.05)

(58) Field of Classification Search
CPC ..... D01G 13/00; D01G 15/02; D04H 1/50
See application file for complete search history.

(56) References Cited

U.S. PATENT DOCUMENTS

| | | | | |
|---|---|---|---|---|
| 2,682,085 | A * | 6/1954 | Novotny | D01G 9/00 209/147 |
| 4,418,103 | A * | 11/1983 | Tani | D04H 1/00 428/6 |
| 4,499,632 | A * | 2/1985 | Varga | B21C 1/14 19/112 |
| 4,761,857 | A * | 8/1988 | McFarlane | D01G 15/70 19/106 R |
| 5,737,806 | A * | 4/1998 | Leifeld | D01G 23/04 19/305 |
| 6,232,249 | B1 | 5/2001 | Kawada | |
| 6,905,528 | B2 * | 6/2005 | Rubenach | D01G 23/08 209/250 |
| 2006/0026801 | A1 * | 2/2006 | Pinto | D04H 1/736 19/98 |
| 2007/0105469 | A1 | 5/2007 | Manner | |
| 2007/0137000 | A1 * | 6/2007 | Bachmann | D01G 15/26 19/98 |
| 2008/0236178 | A1 * | 10/2008 | Hosel | D01G 15/12 257/E23.099 |
| 2009/0101294 | A1 * | 4/2009 | Young | D01G 9/04 162/123 |
| 2013/0037481 | A1 * | 2/2013 | Lalouch | D04H 1/43835 427/244 |
| 2017/0211209 | A1 * | 7/2017 | Saldarini | A41D 3/00 |
| 2017/0211228 | A1 * | 7/2017 | Bashir | D01G 21/00 |

FOREIGN PATENT DOCUMENTS

| | | | |
|---|---|---|---|
| CN | 102605447 | B | 10/2014 |
| EP | 0067498 | A1 | 12/1982 |
| EP | 1717192 | A1 | 11/2006 |
| GB | 2370284 | A | 6/2002 |
| WO | 98/00593 | A1 | 1/1998 |
| WO | 2016/032871 | A1 | 3/2016 |

OTHER PUBLICATIONS

International Search Report in PCT/IB2018/056703 dated Nov. 26, 2018.
International Preliminary Report on Patentability in PCT/IB2018/056703 dated Oct. 7, 2019.
English Abstract for CN102605447 dated Jul. 25, 2012.

* cited by examiner

*Primary Examiner* — Shaun R Hurley
(74) *Attorney, Agent, or Firm* — HEDMAN & COSTIGAN, P.C.; James V. Costigan; Kathleen A. Costigan

(57) ABSTRACT

A free fibre or loose fibre structure for padding comprising a shell containing a plurality of free or loose fibres, said structure being characterised in that said free or loose fibres have a cut that reproduces the length, and in part the fineness, of genuine goose down.

4 Claims, No Drawings

FREE FIBRE PADDING STRUCTURE AND METHOD FOR THE PRODUCTION THEREOF

BACKGROUND OF THE INVENTION

The present invention relates to a free fibre or loose fibre structure for producing padding, particularly for garments and the like, and a method for the manufacture of this fibre structure.

As is known, in padded garments, sleeping bags and the like, the padding is mainly produced using down and/or synthetic fibres.

Normally, the synthetic fibres are processed in laps of different weights and thicknesses.

Both these materials, fibres and down provide the user with good heat insulation and comfort.

In recent years, the use of unprocessed synthetic or natural fibres, applied without mechanical or chemical treatments, has become widespread.

For this purpose, a plurality of separate fibres, each with a length that can vary from 36 mm up to 65 mm and longer, are used. This length is an international standard.

The single unprocessed fibres allow two advantages to be obtained.

Firstly, they allow the softness and appearance of down to be imitated and, secondly, they allow the product to be manufactured at a relatively lower cost compared to the product made of down and to processed wadding.

The reduction in production costs is due, rather than to the lower cost of the material, to the simplicity and low production costs of the product.

In fact, manufacturers of garments have the shells made in various parts of the world and, after receiving them, fill them directly in their factories with simple and automated systems.

Products produced with loose fibres initially have optimal properties, both from a functional and aesthetic point of view.

However, already after the first wash, these products exhibit a serious problem.

In fact, after the product is washed in water, even at low temperatures, the aforesaid loose fibres clump together and become entangled, creating clusters and consequently leaving empty areas in the product.

In other words, an uneven distribution of the fibres is created and consequently the product does not have uniform insulation and therefore the main purpose of the padding is no longer fulfilled.

In fact, the product has warm areas and cold areas, as has been observed experimentally by means of thermographies performed before and after the wash.

CN102605447 describes a velveteen regeneration polyester super-short fibre which is prepared from regenerative PET materials by raw material pre-treatment, rotary drum drying, spinning, cold forming, and other steps. The cut length of the product obtained is between 3 and 12 mm and the product has the appearance and handle feel similar to those of down.

US2007/105469 describes the use of a cellulosic staple fibre of Lyocell type having a ratio value between titre (in dtex) and cut length (in mm) of 0.10 or greater as filling fibre for bedding, pillows, mattresses or furniture padding.

EP1717192 describes a filling material for filling bedding articles and the like comprising polyester fibres having an average dimension of 0.5 to 2.5 dtex and being coated with a slickener and crimped. The fibres have been cut to an average length of 4-15 mm and have subsequently been opened.

SUMMARY OF THE INVENTION

The aim of the present invention is to produce a free fibre or loose fibre structure for producing padding and a method for the manufacture thereof that allows a much higher filling power to be obtained compared to products obtained using conventional processing methods.

Within this aim, an object of the invention is to produce a fibre structure having an increased insulating power, with the same weight, with respect to conventional fibres, and comparable to the insulating power of high quality down.

Another important object of the present invention is to provide a free fibre or loose fibre structure and a method for the manufacture thereof that allows the production of padding that can be washed without losing its original insulation properties.

A further object of the present invention is to provide a structure that can be manufactured inexpensively.

This and other objects, which will become more apparent below, are achieved by a free fibre or loose fibre structure for padding and by a method for manufacturing it as claimed in the appended claims.

Further characteristics and advantages of the subject-matter of the present invention will become more apparent through examination of the description of a preferred, but not exclusive, embodiment of the invention.

DESCRIPTION OF THE PREFERRED EMBODIMENT

The loose fibre structure for producing padding according to the present invention is characterised by comprising a fibre cut that reproduces the length, and in part the fineness, of genuine goose down.

According to the present invention, the fibres of the structure have a variable length, from 2 to 28 mm, with a titre or count that ranges from 0.8 den to 4 den.

The length of the fibres of the present invention is very different from the cut currently most commonly used for loose fibre products, which have a cut of 36 or 65 mm.

According to the present invention, the structure can comprise microfibres of synthetic fibres or others.

The fibres can have surface treatments, for example silicone coating, and/or directly in the fibre, for example hollow, two-component, etc., and different shape, smooth, crimped, spiral, and of various type, synthetic, natural or a blend of both.

Blends of these fibres are then prepared with different concentrations.

The fibres can be used without any further treatment, blowing them directly into the structure with the same system and machinery used to produce conventional down padding.

The best results for volumetric yield of the product are obtained by producing the fibres with the following manufacturing method.

Before processing, the fibres are fed into a blending chamber, in which they are also treated with antistatic agents for 48 hours.

To allow continuous processing, several blending chambers are advantageously used.

These treated fibres are then collected to be blown into the opening machine.

The fibres are sent pneumatically into a high ventilation chamber where they can also be blended with different types of fibres or with other materials. A strong ventilation facilitates opening of the fibre staples.

Suction of the fibres takes place in a machine with two rotating cylinders which start to open the fibres and are then fed to another sector with rotating discs.

The fibres are transferred directly to a carding willow equipped with well-defined gaskets.

Complete separation of the fibres from one another takes place in a last passage through a modified opener with special gaskets (from V6 to V20 and others) on different cylinders.

These passages allow complete opening of the fibres without stressing them and consequently without losing their original crimp properties.

The aim of this process is to reach the maximum degree of opening and volume of the fibres without stressing them and consequently without damaging the fibres.

During processing, the fibres in the machine are brought to a temperature ranging between about 50 and 80° C. and are moved by ventilation systems that cause them to curl, a factor that makes the fibres more resilient and that therefore makes it possible to use less material to obtain the same level of filling.

This opening of the fibres by means of ventilation prevents stretching of the fibres, as instead occurs in conventional carding methods, and therefore maintains the crimp and curl properties of the fibre without stressing it.

Thanks to this process, with the fibre obtained it is possible to reach "fill power" of 600+ cuin ($in^3$/oz), remarkably higher compared to the 300-400 cuin of conventional products obtained with known processes.

This greater volume achieved by the processed fibre ensures that its insulating power is higher, with the same weight, compared to a conventional fibre, and is comparable to the insulating power of high quality down.

For example, a double amount by weight of the conventional 300 cuin fibre is required compared to the fibre produced with the 600 cuin method of the present invention.

The method of the present invention allows a great saving, due to the smaller quantity of material to be used and also due to energy savings during production.

The present fibre structure manufactured with the method of the invention also allows a saving in the weight of the final garment to be obtained.

The following table sets down the fill power results for different products:

| | Fill power (cuin) |
|---|---|
| Down | 610 |
| Patent product 1 | 600 |
| Patent product 2 | 537 |
| Conventional product 1 | 350 |
| Conventional product 2 | 510 |
| Conventional product 3 | 440 |
| Conventional product 4 | 340 |

The values cited above were measured in a standard manner, following the standard used for down (IDFB part 10-B—2015).

As further confirmation of the level of opening and hence of filling of a garment, the insulating power (in CLO values) of a garment produced with fibre opened with the method of the present invention was compared with a similar product opened with conventional techniques.

It is evident from the results, set down in the table below, that the insulation provided by the fibres produced according to the present invention is much greater than conventional insulation.

| CLO products 135 g/$m^2$, 3.5 cm tubes | |
|---|---|
| Invention product | 2.57 |
| Conventional product | 1.57 |

In order to compare the fibre to down, another test was performed and it was observed that the thermal insulation values are similar, as indicated in the table below.

| Comparison with down 200 g/$m^2$, 5 cm tubes | |
|---|---|
| Invention product | 2.78 |
| Down 90/10 | 2.94 |

The final product, i.e. the free fibre or loose fibre structure, is used by the manufacturer of the product as for the products made of down.

With this production method, products manufactured with micro-cut free fibres or loose fibres according to the present invention, separate from one another, will no longer have the problem described above, as the fibres will no longer be able to cluster and couple mechanically with each other.

The free fibres or loose fibres of the structure according to the present invention have the same behaviour as down after washing and any clumps can be eliminated simply by shaking the dry product by hand.

The warmth is uniform throughout the product, which therefore has optimal insulation.

This is due to the fact that the configuration inside the structure is composed of millions of parts that deposit randomly creating as many air pockets, forming a thermal barrier composed of more than 90% of air, which is known to be the best insulating material.

Another characteristic of the present invention is the possibility of regulating the breathability of a product and its insulation in different areas of the product simply by moving the mass of fibres as required.

In fact, with a very simple operation, it is possible to separate large areas of fibre mass increasing or decreasing the density of the insulating material.

Moreover, the possibility of regulating the amount of fibres allows the breathability of the product to be increased or decreased according to requirements.

An important characteristic of the method of the present invention is that the fibres are not damaged during opening.

In practice, it has been found that the invention achieves the intended aim and objects.

In fact, a fibre product has been produced that is designed particularly for producing padding for garments, sleeping bags, quilts, etc., which ensures that its optimal heat insulating properties are maintained even after repeated washing.

Naturally, the materials used, as well as their sizes, can be any, according to requirements.

The invention claimed is:

1. A method for the manufacture of a free fibre or loose fibre padding, said fibre padding comprising a plurality of free or loose fibres, said free or loose fibres having a length ranging between 2 and 28 mm, with a titre or count that ranges between 0.8 den and 4 den; said method comprising sequential steps of:

feeding said fibres through a bale opener;

pneumatically sending said fibres into a ventilation chamber which performs suction of said fibres by means of two rotating cylinders which start to open said fibres;

feeding said fibres through a subsequent sector with rotating discs; and completing separation of said fibres from one another in a subsequent opener;

whereby during said sequential steps said fibres being brought to a temperature ranging between 50 and 80° C. and being moved by ventilation systems that cause said fibres to curl.

2. The method according to claim 1, wherein said step of completing separation of said fibres with said subsequent opener for completing separation of said fibres, has gaskets on different cylinders.

3. The method according to claim 1, wherein during said step of pneumatically sending said fibres into said ventilation chamber, said fibres are blended with different types of fibres or other materials.

4. The method according to claim 1, further comprising, prior to said step of feeding said fibres through said bale opener, a step of feeding said fibres through a blending chamber, in which said fibres are also treated with antistatic agents for 48 hours.

* * * * *